US008666684B2

(12) United States Patent
Ko et al.

(10) Patent No.: US 8,666,684 B2
(45) Date of Patent: Mar. 4, 2014

(54) AIR CONDITIONING SYSTEM AND METHOD FOR CALCULATING AMOUNT OF FILLING REFRIGERANTS OF THE SAME

(75) Inventors: Seungtae Ko, Seoul (KR); Sangchul Youn, Seoul (KR); Chisun Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 425 days.

(21) Appl. No.: 13/044,290

(22) Filed: Mar. 9, 2011

(65) Prior Publication Data

US 2011/0224921 A1 Sep. 15, 2011

(30) Foreign Application Priority Data

Mar. 10, 2010 (KR) ..... 10-2010-0021461
Mar. 29, 2010 (KR) ..... 10-2010-0028101

(51) Int. Cl.

| | |
|---|---|
| ***G01F 17/00*** | (2006.01) |
| ***F25B 39/04*** | (2006.01) |
| ***G01F 25/00*** | (2006.01) |
| ***G05D 9/00*** | (2006.01) |

(52) U.S. Cl.
USPC ..... 702/55; 62/184; 73/1.31; 700/281

(58) Field of Classification Search
USPC ..... 702/55, 33, 45, 47, 50, 53, 57, 64–65, 702/81, 84, 97, 100, 127, 155–158, 170, 702/182, 189; 62/103, 117–118, 177–179, 62/184; 324/600, 602, 605, 607, 609, 691, 324/699, 713; 73/1.16, 1.31, 1.73; 700/275–277, 281–282
See application file for complete search history.

(56) References Cited

U.S. PATENT DOCUMENTS 4,935,884 A 6/1990 Hajicek ..... 702/159

FOREIGN PATENT DOCUMENTS

| | | |
|---|---|---|
| EP | 0 296 392 | 6/1988 |
| JP | 08-021717 | 1/1996 |
| JP | 08-00905 | 8/1996 |
| JP | 11-063745 | 3/1999 |
| JP | 2005-076939 | 3/2005 |
| JP | 2007-085892 | 4/2007 |
| KR | 20-1998-0062839 | 11/1998 |
| KR | 10-2001-0004763 | 1/2001 |
| KR | 10-0850952 | 8/2008 |
| KR | 10-2010-0028953 | 3/2010 |

OTHER PUBLICATIONS

JP11063745—English Version, Mar. 5, 1999, 12 pp.*
JP2005076939—English Version, Mar. 24, 2005, 18 pp.*
European Search Report dated Jul. 25, 2011.
Korean Office Action dated Aug. 16, 2012 for Korean Application No. 10-2010-0028101.
Korean Office Action dated Aug. 23, 2012 for Korean Application No. 10-2010-0021461.

* cited by examiner

*Primary Examiner* — Toan Le
(74) *Attorney, Agent, or Firm* — KED & Associates LLP

(57) ABSTRACT

An air conditioning system includes a plurality of indoor units and one or more outdoor units to drive the indoor units. The one or more outdoor units are coupled to the indoor units through refrigerant pipes that include one or more branch points. A calculator calculates an amount of filling refrigerant based on capacities of the indoor units and the one or more outdoor units and lengths of the refrigerant pipes.

17 Claims, 10 Drawing Sheets

AIR CONDITIONING SYSTEM AND METHOD FOR CALCULATING AMOUNT OF FILLING REFRIGERANTS OF THE SAME

CROSS-REFERENCE TO RELATED APPLICATIONS

Pursuant to 35 U.S.C. §119(a), this application claims the benefit of and right of priority to Korean Applications No. 10-2010-0021461, filed on Mar. 10, 2010, and No. 10-2010-0028101, filed on Mar. 29, 2010, the contents of which are incorporated herein by reference.

BACKGROUND

1. Field

One or more embodiments herein relate to an air conditioning system.

2. Background

An air conditioning system generally includes an indoor unit and an outdoor unit, which are driven to cool and heat one or more areas according to a user's request. The indoor unit and the outdoor unit are typically connected to each other through a refrigerant pipe.

Recently, a multi-air conditioning system has been developed to include a plurality of multi-air conditioners having an outdoor unit for controlling distribution and circulation of a refrigerant, indoor units for discharging air to each chamber by being commonly connected to the outdoor unit, and a controller for controlling the multi-air conditioners by connecting the multi-air conditioners to one another.

For instance, as shown in FIG. 1, an air conditioning system includes one outdoor unit 200, and a plurality of indoor units 100A-100D connected to the outdoor unit 200 through a refrigerant pipe 300.

Such an air conditioning system circulates a refrigerant, an operation fluid, in the order of a compressor, a condenser, an expansion valve and an evaporator, or in a reverse order, thereby heating or cooling an indoor chamber. This refrigerant is filled in the air conditioning system by a predetermined amount according to a capacity of the air conditioning system when installing the air conditioning system.

However, as the air conditioning system is continuously used, the refrigerant is consumed to become deficient. This may degrade efficiency of the air conditioning system. Accordingly, a new refrigerant has to be supplemented. To this end, have been developed techniques for constantly maintaining a refrigerant amount by filling a refrigerant into an air conditioning system according to a capacity of the air conditioning system.

The refrigerant pipe which connects the outdoor unit and the indoor unit to each other is installed in a building in advance. As the number of the outdoor units and indoor units is increased or as a distance between the outdoor unit and the indoor unit(s) becomes long, the refrigerant pipe must also be increased in length.

The air conditioning system has a different pipe length and a different amount of refrigerants to be filled according to an installation environment. This may cause a difficulty in properly maintaining a refrigerant amount.

Furthermore, when directly applying the conventional technique for filling refrigerants to an air conditioning system to a recent multi-air conditioning system, an error may occur in calculating a refrigerant amount according to installation conditions such as a pipe length, etc.

Furthermore, when determining a refrigerant amount by measuring a temperature and a pressure in the conventional art, a larger number of temperature sensors or pressure sensors have to be installed as a pipe length is increased. This may cause high costs, and may degrade reliability when measuring a smaller number of sensors.

One of the conventional methods for calculating a refrigerant amount is to determine whether a refrigerant amount is proper or not by filling an additional refrigerant amount in an air conditioning system, and then by driving the air conditioning system. In this case, since whether a refrigerant amount is proper or not is determined after filling an additional refrigerant amount in an air conditioning system, an installation time of the air conditioning system is increased.

Furthermore, since an additional refrigerant amount is directly calculated by a user, the user's convenience may be lowered. Also, a refrigerant amount may be wasted, and a refrigerant amount error may occur according to a user's capability.

DETAILED DESCRIPTION

Figure 1:
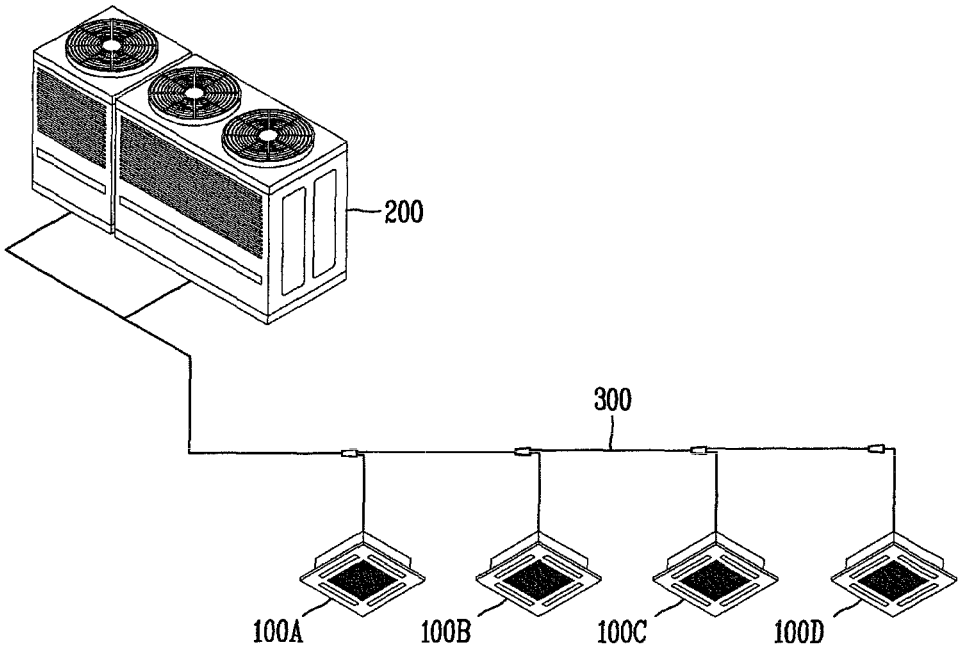
FIG. 1 shows a convention air conditioning system.
Figure 2:
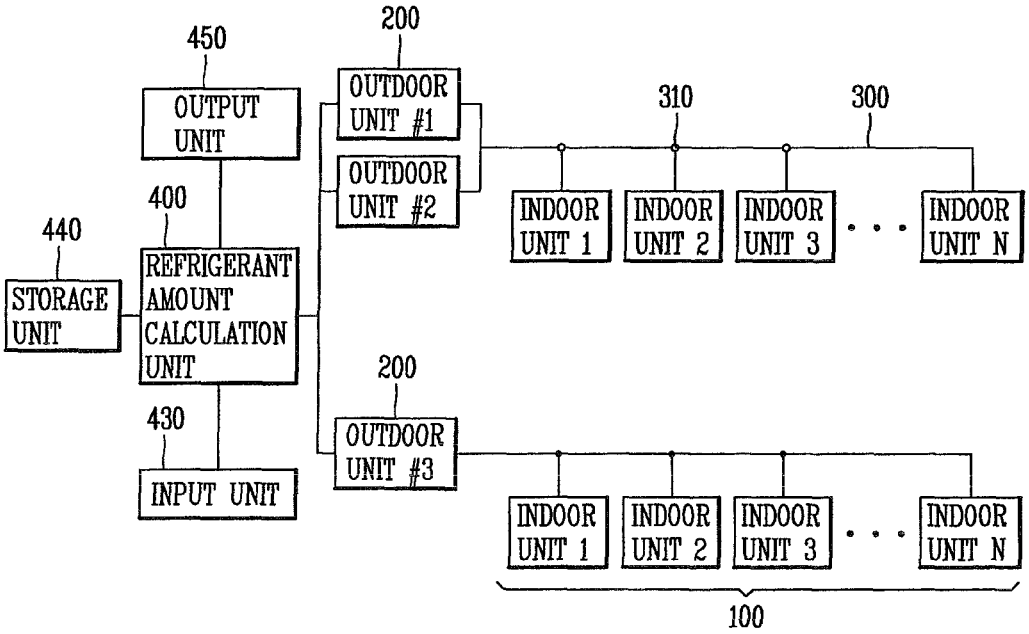
FIG. 2 shows a first embodiment of an air conditioning system.

Referring to FIG. 2, an air conditioning system according to a first embodiment of the present disclosure includes a plurality of indoor units 100 configured to perform air conditioning processes, one or more outdoor units 200 connected to the indoor units 100 through a refrigerant pipe including one or more branch points 310 and configured to drive the indoor units, and a refrigerant amount calculation unit 400 configured to calculate an amount of filling refrigerants based on capacities of the indoor units and the outdoor unit and a length of the refrigerant pipe.

The refrigerant amount calculation unit 400 calculates an amount of filling refrigerants by adding an indoor unit filling refrigerant amount according to a capacity of the indoor units, an outdoor unit filling refrigerant amount according to a capacity of the outdoor unit, and a pipe filling refrigerant amount to one another.

More concretely, the refrigerant amount calculation unit 400 calculates an amount of filling refrigerants by multiplying an outdoor unit filling refrigerant amount according to a capacity of the outdoor unit and an indoor unit filling refrigerant amount according to capacities of the indoor units, with a value obtained by multiplying a pipe filling refrigerant amount per a unitary length with a length of a refrigerant pipe, or by adding the outdoor unit filling refrigerant amount according to a capacity of the outdoor unit and the indoor unit filling refrigerant amount according to capacities of the indoor units to a preset pipe filling refrigerant amount.

The air conditioning system according to the first embodiment of the present disclosure may further include a storage unit 440 configured to store a filling refrigerant amount of the refrigerant pipe. And, the refrigerant amount calculation unit 400 may calculate the filling refrigerant amount based on the pre-stored filling refrigerant amount of the refrigerant pipe.

The air conditioning system according to the first embodiment of the present disclosure may further include an input unit 430 configured to receive information on the branch points. Here, the information on the branch points includes not only the number of the branch points, but also a dimension of the branch points. In case of a secondary branch or more, the information on the branch points includes the number of secondary branch groups, a secondary branch starting point, the number of indoor units inside the secondary branch, etc.

Figure 11:
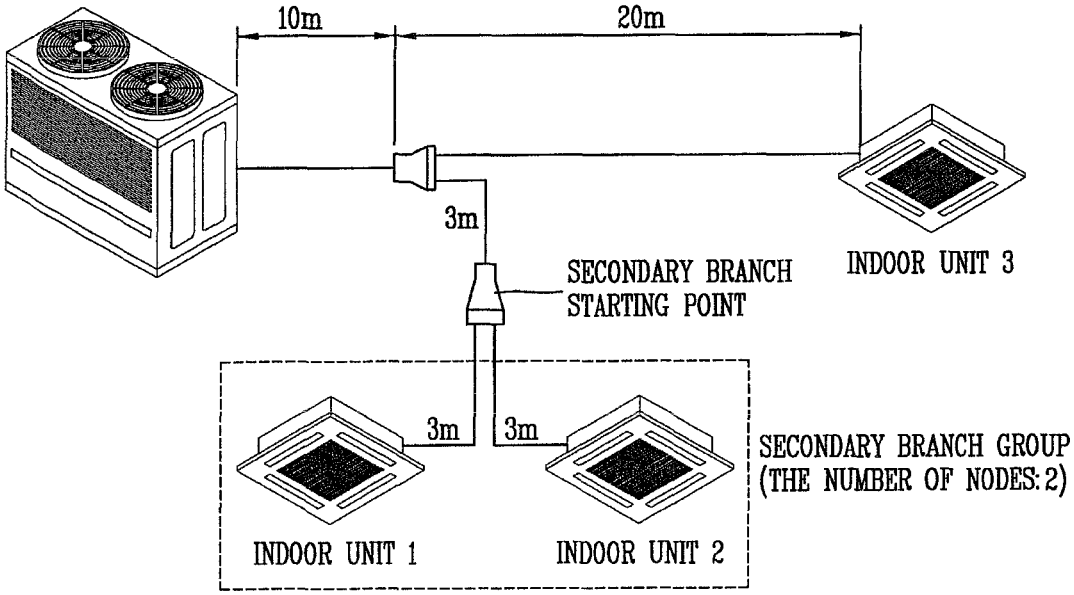
FIG. 11 shows one embodiment of a method for detecting the length of a refrigerant pipe.

Referring to FIG. 11, three indoor units are connected to one outdoor unit by a refrigerant pipe, and the refrigerant pipe includes two branch points. Here, the second branch point indicates a starting point of the secondary branch. That is, in case of a secondary branch or more, the information on the branch points includes the number of secondary branch groups (one in FIG. 11), a secondary branch starting point (first indoor unit of FIG. 11), the number of indoor units inside the secondary branch group (second indoor unit of FIG. 11), etc. The present disclosure may be also applied to an air conditioning system having a tertiary branch or more.

The air conditioning system according to the first embodiment of the present disclosure may further include an output unit 450 configured to display one or more information on a connection status among the indoor units, the outdoor unit and the refrigerant pipes, and the filling refrigerant amount.

Referring to FIG. 2, the refrigerant amount calculation unit 400 is connected to one or more outdoor units 200. However, the refrigerant amount calculation unit 400 may be connected between the outdoor unit and the indoor unit, or may be installed at the end of the indoor unit.

Figure 3:
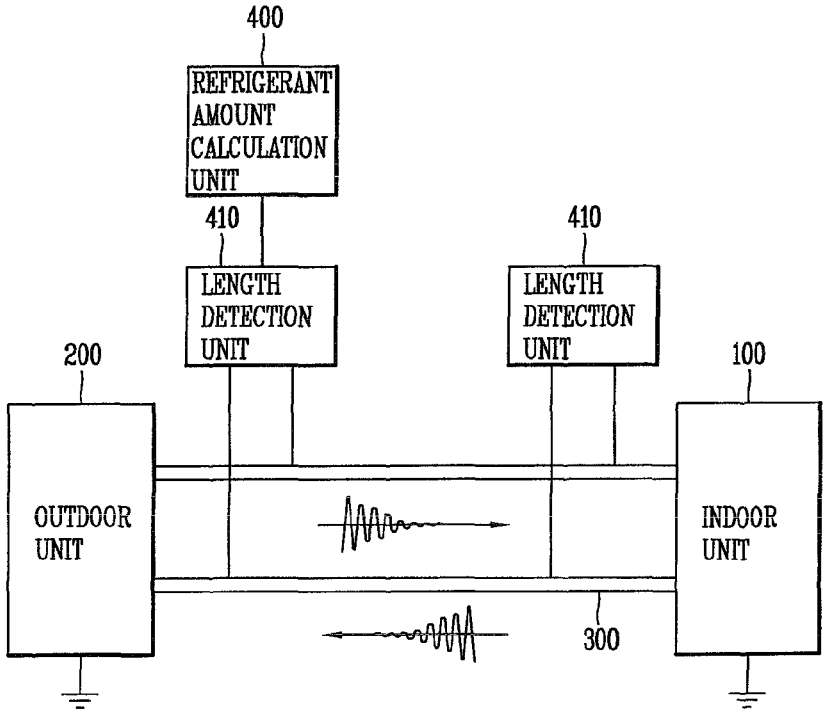
FIGS. 3 and 4 show a second embodiment of an air conditioning system.

Referring to FIG. 3, the air conditioning system according to the second embodiment of the present disclosure may include a plurality of indoor units 100 configured to perform air conditioning processes, one or more outdoor units 200 connected to the indoor units 100 through a refrigerant pipe 300 including one or more branch points 310 and configured to drive the indoor units, a length detection unit 410 connected to each of the outdoor unit and the indoor units, and configured to detect a length of the refrigerant pipe based on a strength of a signal received by the outdoor unit or the indoor units, and a refrigerant amount calculation unit 400 configured to calculate an amount of filling refrigerants based on capacities of the indoor units and the outdoor unit and a length of the refrigerant pipe. The same contents aforementioned in the first embodiment will be omitted.

Figure 8:
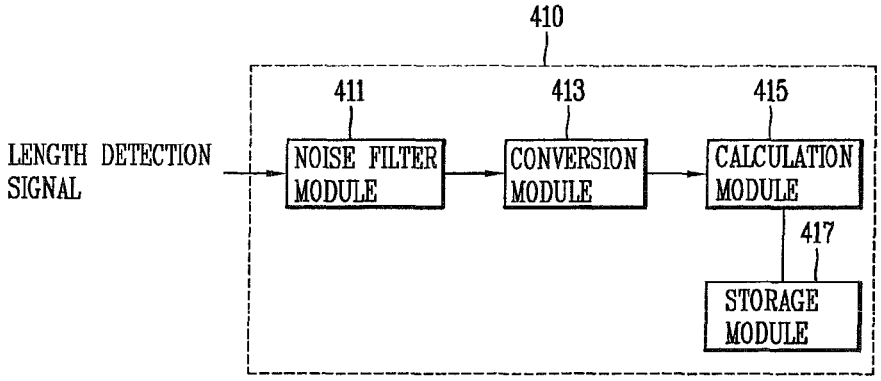
FIG. 8 shows one example of a length detection unit.

Referring to FIG. 8, the length detection unit 410 further includes a noise filter module 411 configured to remove noise from the received signal, a conversion module 413 configured to convert the received signal into a digital signal, and a calculation module 415 configured to calculate a length of the refrigerant pipe based on the digital signal.

The noise filter module 411 is provided with a band pass filter (BPF), and is configured to remove an external noise signal of the length detection signal, i.e., a received signal.

The conversion module 413 includes an analogue-digital converter configured to convert an analogue signal into a digital signal. Once a length detection signal transmitted from the outdoor unit or the indoor units is received to the length detection unit 410 through the refrigerant pipe, the noise filter module 411 removes a noise signal from the received signal. And, the conversion module 413 converts the received signal having a noise signal removed therefrom, into a digital signal, and then transmits the converted digital signal to the calculation module 415.

The length detection unit 410 generates an equivalent circuit based on the length detection signal and the received signal. The calculation module 415 detects a length of the refrigerant pipe by using the equivalent circuit. The equivalent circuit is differently formed according to an installation environment. For instance, a length detection unit installed at the outdoor unit may be indicated by 'Vin', and length detection units installed at the plurality of indoor units may be indicated by 'V1, V2, . . . Vn'. In the equivalent circuit, each branch point is indicated by a node. And, refrigerant pipes connected to the respective branch points are indicated by impedances (resistances), which may be indicated as Z1, Z2, . . . Z2*n*−1, sequentially. An impedance of the refrigerant pipe may be calculated by Equation 1 by applying Kirchhoff's voltage laws (KVL) to the equivalent circuit.

$$Z_{pipe}=I^{-1}V \tag{1}$$

Here, a length of the refrigerant pipe may be calculated by Equation 2.

$$\text{pipelength}=Z_{pipe}/\alpha \tag{2}$$

Here, 'α' indicates an impedance per a unitary length.

Figure 9:
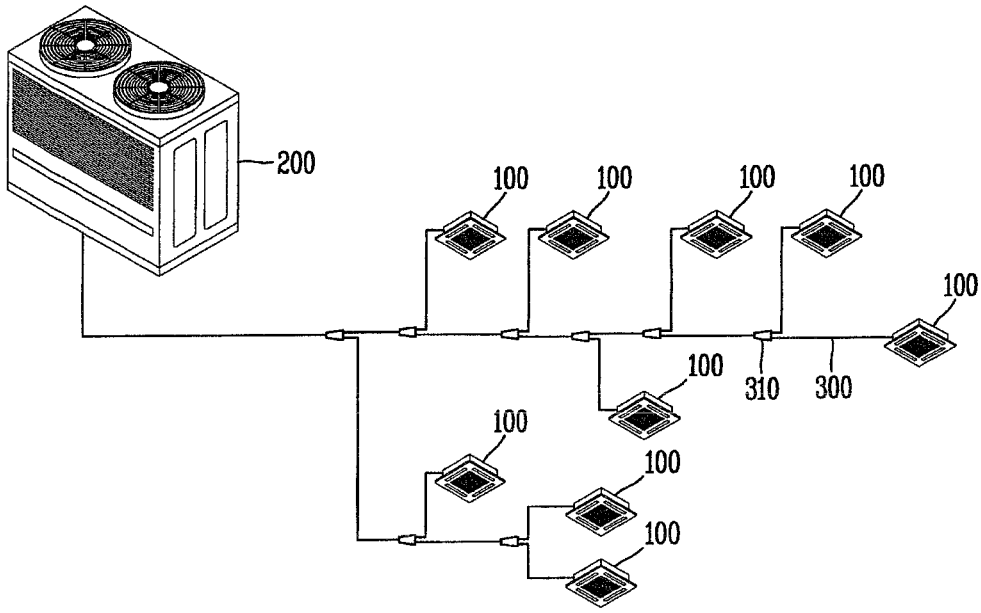
FIG. 9 shows a secondary branch which may be used in accordance with any of the aforementioned air conditioning system embodiments.
Figure 10:
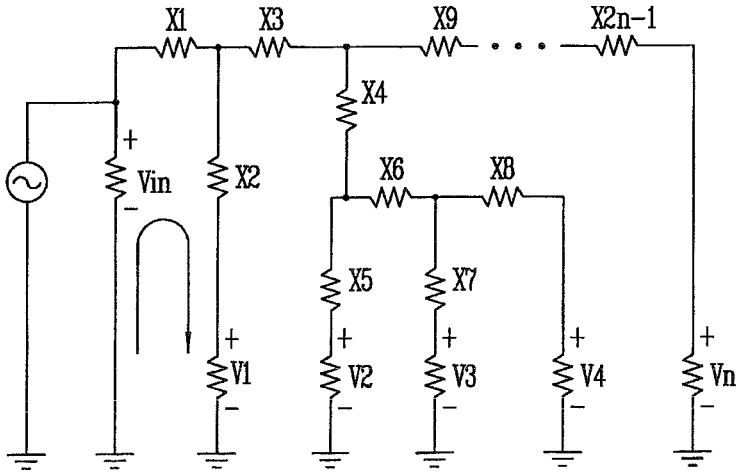
FIG. 10 is a view of an equivalent circuit that may be used in the air conditioning system of FIG. 9.

FIG. 9 is a view schematically showing an air conditioning system having a secondary branch according to the present disclosure, and FIG. 10 is a view of an equivalent circuit of FIG. 9.

Referring to FIGS. 9 and 10, each branch point of FIG. 9 is indicated by a node of FIG. 10, refrigerant pipes among the outdoor unit, the indoor units and the branch points are indicated by impedances (resistances), and each length detection unit 410 is indicated by a voltage having a predetermined resistance. The indoor units which constitute the secondary branch of FIG. 9 are indicated by 'V2~V4' in FIG. 10, and the refrigerant pipes which connect the indoor units to each other form a small circuit of 'X4~X8'.

The length detection unit 410 may further include a storage module 417 configured to store a length of the refrigerant pipe. The storage module 417 stores a signal received by the length detection unit 410, and stores a digital signal converted by the conversion module 413.

Figure 4:
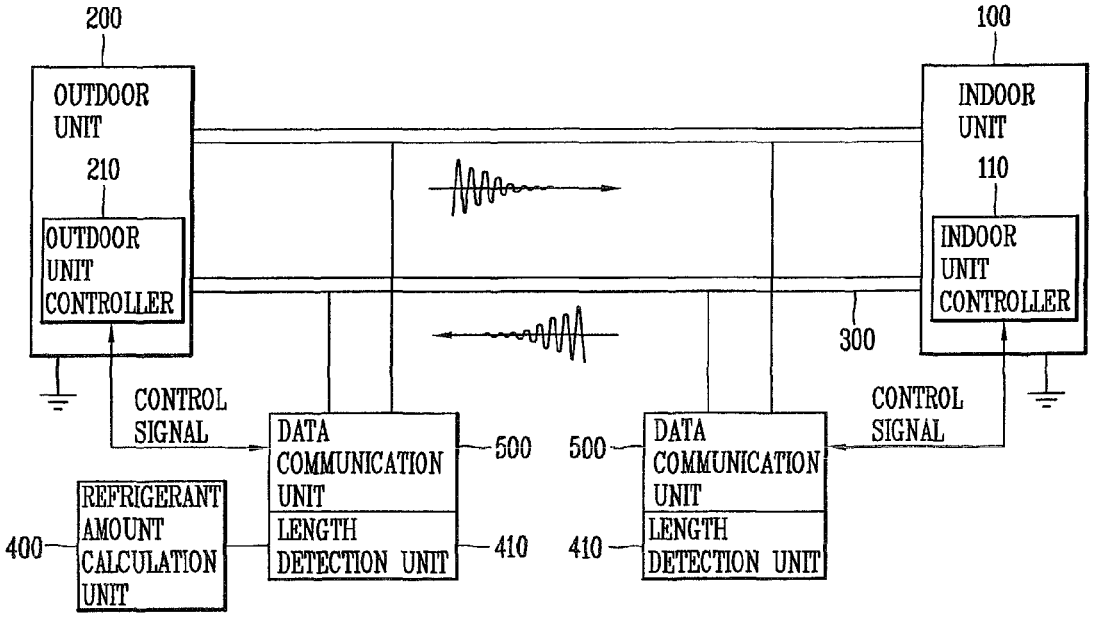

Referring to FIG. 4, in the air conditioning system according to the second embodiment of the present disclosure, the outdoor unit and the indoor unit are provided with an outdoor unit controller 210 and an indoor unit controller 110, respectively. The air conditioning system according to the second embodiment of the present disclosure further includes a data communication unit 500 connected between the indoor unit controller 110 and the length detection unit 410, and between the outdoor unit controller 210 and the length detection unit 410, and configured to transmit and receive data between the outdoor unit 200 and the indoor units 100.

The data communication unit 500 is configured to allow the outdoor unit or the indoor units to transmit or receive driving data thereof through the refrigerant pipes, or additional exclusive lines (e.g., RS-485). In FIG. 4, the data communication unit 500 and the length detection unit 410 are separately configured, but may be integrally configured as one unit. In this case, identifiers are used to distinguish a length detection signal and a signal for driving data from each other.

The air conditioning system according to the second embodiment of the present disclosure may further include a storage unit (not shown) configured to store a pipe filling refrigerant amount per a unitary length, and the refrigerant amount calculation unit 400 may calculate the filing refrigerant amount based on the pre-stored pipe filling refrigerant amount per a unitary length, and the detected pipe length. Here, the pipe filling refrigerant amount per a unitary length is variable according to a thickness of the refrigerant pipe, etc.

The air conditioning system according to the second embodiment of the present disclosure may further include an input unit (not shown) configured to receive information on the branch points. Here, the information on the branch points includes not only the number of the branch points, but also a dimension of the branch points. In case of a secondary branch or more, the information on the branch points includes the number of secondary branch groups, a secondary branch starting point, the number of indoor units inside the secondary branch group, etc.

Referring to FIG. 11, three indoor units are connected to one outdoor unit by a refrigerant pipe, and the refrigerant pipe includes two branch points. Here, the second branch point indicates a starting point of the secondary branch. That is, in case of a secondary branch or more, the information on the branch points includes the number of secondary branch groups (one in FIG. 11), a secondary branch starting point (first indoor unit of FIG. 11), the number of indoor units inside the secondary branch group (second indoor unit of FIG. 11), etc. The present disclosure may be also applied to an air conditioning system having a tertiary branch or more.

The air conditioning system according to the second embodiment of the present disclosure may further include an output unit (not shown) configured to display one or more information on a connection status among the indoor units, the outdoor unit and the refrigerant pipe, a length of the refrigerant pipe, and the filling refrigerant amount.

Figure 5:
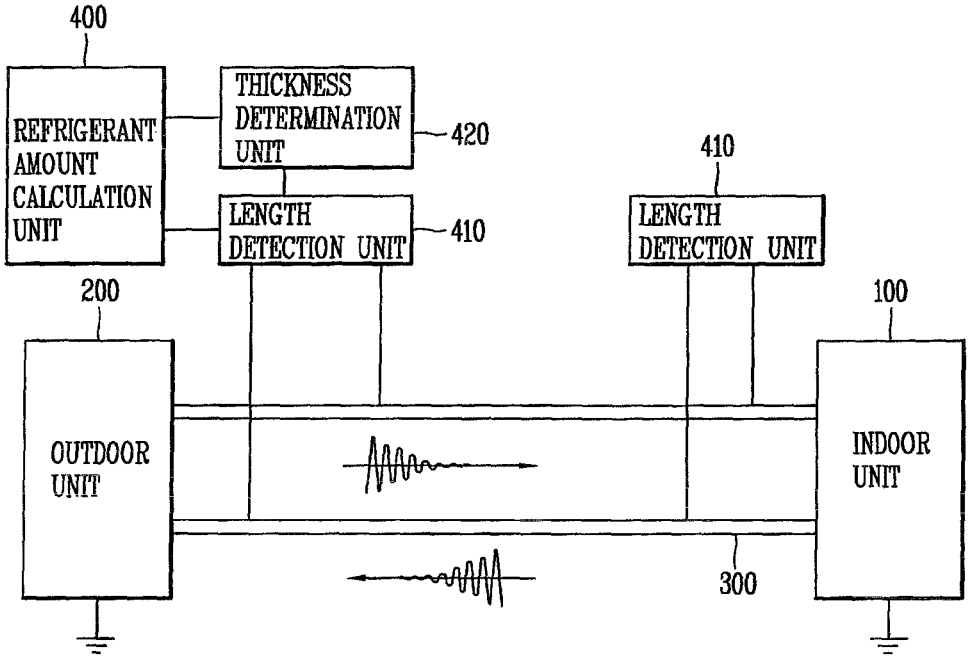
FIGS. 5 and 6 show a third embodiment of an air conditioning system.

Referring to FIG. 5, the air conditioning system according to the second embodiment of the present disclosure may include a plurality of indoor units 100 configured to perform air conditioning processes, one or more outdoor units 200 connected to the indoor units 100 through a refrigerant pipe 300 including one or more branch points 310 and configured to drive the indoor units, a length detection unit 410 connected to each of the outdoor unit and the indoor units, and configured to detect a length of the refrigerant pipe based on a strength of a signal received by the outdoor unit or the indoor units, and a refrigerant amount calculation unit 400 configured to calculate an amount of filling refrigerants based on capacities of the indoor units and the outdoor unit and a length of the refrigerant pipe. The same contents aforementioned in the first embodiment will be omitted.

Referring to FIG. 5, the air conditioning system according to the third embodiment of the present disclosure includes a plurality of indoor units 100 configured to perform air conditioning processes, one or more outdoor units 200 connected to the indoor units 100 through a refrigerant pipe 300 including one or more branch points 310 and configured to drive the indoor units, a length detection unit 410 connected to each of the outdoor unit and the indoor units, and configured to detect a length of the refrigerant pipe based on a strength of a signal received by the outdoor unit or the indoor units, a thickness determination unit 420 configured to determine a thickness of the refrigerant pipe based on capacities of the outdoor unit and the indoor units, and a refrigerant amount calculation unit 400 configured to calculate an amount of filling refrigerants based on capacities of the indoor units and the outdoor unit and a length of the refrigerant pipe. The same contents aforementioned in the first and second embodiments will be omitted.

The refrigerant amount calculation unit 400 calculates an amount of filling refrigerants by adding an indoor unit filling refrigerant amount, an outdoor unit filling refrigerant amount, and a pipe filling refrigerant amount to one another. Here, the pipe filling refrigerant amount is determined by a length and a thickness of the refrigerant pipe. Here, the refrigerant amount calculation unit 400 may calculate the filling refrigerant amount based on the pre-stored pipe filling refrigerant amount.

The thickness determination unit 420 determines a pipe thickness between the outdoor unit and a branch point nearest to the outdoor unit, based on a capacity of the outdoor unit. For instance, the thickness determination unit 420 may determine a pipe thickness between the outdoor unit and a branch point nearest to the outdoor unit by using preset information shown in the table 1. Here, the values shown in the following table 1 may be variable according to a type of the outdoor unit, or an installation environment of the air conditioning system. For instance, when a pipe connected to a first branch point has a thickness (pipe diameter) thicker than that of a main pipe, or when a pipe length up to an indoor unit farthest from the outdoor unit is more than 90 m, a thickness of the refrigerant pipe, especially, the main pipe may be corrected.

TABLE 1

| Capacity of outdoor unit (HP) | Pipe (mm) |
|---|---|
| 5~10 | 9.52 |
| 12~16 | 12.7 |
| 20 | 15.88 |
| 28~30 | 19.05 |

A thickness of a refrigerant pipe between the outdoor unit and a branch point nearest to the outdoor unit may be set with consideration of capacities of the outdoor unit and the indoor units.

The thickness determination unit 420 determines a thickness of a refrigerant pipe between branch points, and each thickness of refrigerant pipes between the branch points and the indoor units based on capacities of the indoor units connected to rear ends of the branch points. A thickness of a refrigerant pipe connected between a first branch point and a second branch point is determined based on capacities of the indoor units connected to the second branch point. For instance, a thickness of a refrigerant pipe between branch points, or each thickness of refrigerant pipes between the branch points and the indoor units may be determined by using information shown in the following table 2.

TABLE 2

| Total capacity of indoor units connected to second branch point (KW) | Pipe (mm) |
|---|---|
| <5.6 | 6.35 |
| <33 | 9.52 |
| <47 | 12.7 |
| <71 | 15.88 |
| <104 | 19.05 |
| 104<= | 19.05 |

Figure 6:
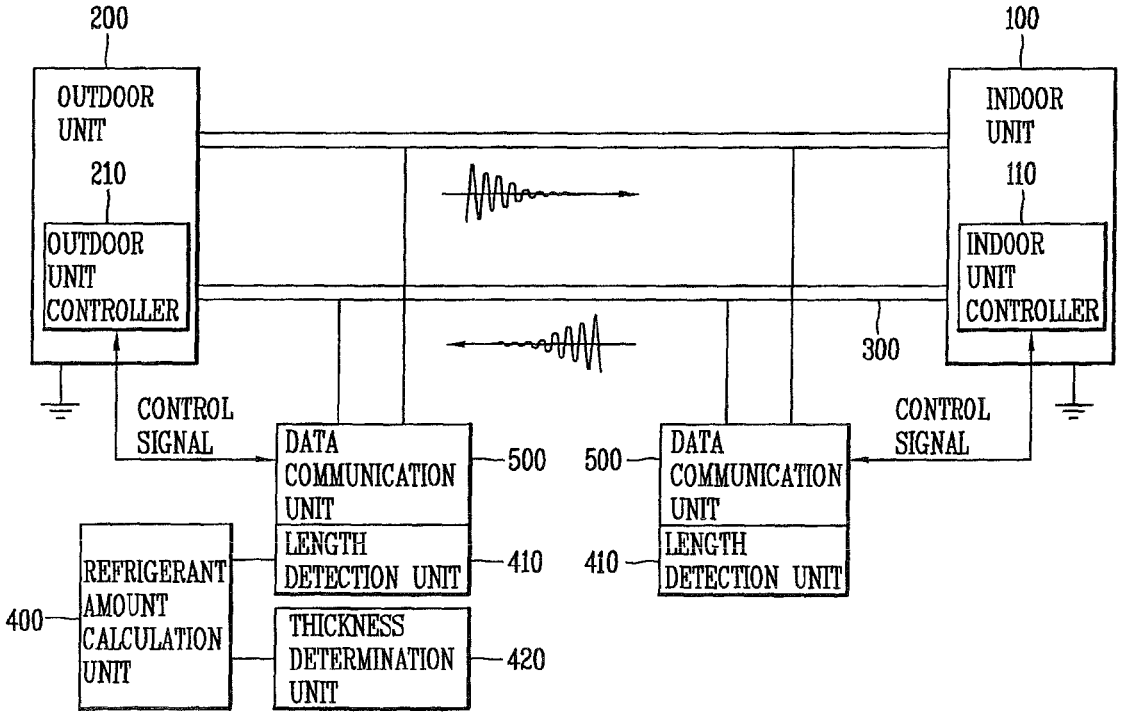

Referring to FIG. 6, in the air conditioning system according to the third embodiment of the present disclosure, the outdoor unit and the indoor unit are provided with an outdoor unit controller 210 and an indoor unit controller 110, respectively. The air conditioning system according to the third embodiment of the present disclosure further includes a data communication unit 500 connected between the indoor unit controller 110 and the length detection unit 410, and between the outdoor unit controller 210 and the length detection unit 410, and configured to transmit and receive data between the outdoor unit 200 and the indoor units 100. The data communication unit 500 is configured to allow the outdoor unit or the indoor units to transmit or receive driving data thereof through the refrigerant pipes, or additional exclusive lines (e.g., RS-485).

In FIG. 6, the data communication unit 500, the length detection unit 410, and the thickness determination unit 420 are separately configured, but may be integrally configured as one unit. In this case, identifiers are used to distinguish a length detection signal and a signal for driving data from each other.

The air conditioning system according to the third embodiment of the present disclosure may further include a storage unit (not shown) configured to store a pipe filling refrigerant amount per a unitary length, and the refrigerant amount calculation unit 400 may calculate the filing refrigerant amount based on the pre-stored pipe filling refrigerant amount per a unitary length, and the detected pipe length. Here, the pipe filling refrigerant amount per a unitary length is variable according to a thickness of the refrigerant pipe, etc. As shown in the tables 1 and 2, the storage unit may pre-store information on a pipe thickness according to an outdoor unit capacity, and a pipe thickness according to an indoor unit capacity. In this case, the thickness determination unit 420 may easily determine a thickness of a refrigerant pipe based on the information shown in the table, and capacities of the outdoor unit and the indoor units.

The air conditioning system according to the third embodiment of the present disclosure may further include an input unit (not shown) configured to receive information on the branch points. Here, the information on the branch points includes not only the number of the branch points, but also a dimension of the branch points. In case of a secondary branch or more, the information on the branch points includes the number of secondary branch groups, a secondary branch starting point, the number of indoor units inside the secondary branch group, etc. Referring to FIG. 11, three indoor units are connected to one outdoor unit by a refrigerant pipe, and the refrigerant pipe includes two branch points.

Here, the second branch point indicates a starting point of the secondary branch. That is, in case of a secondary branch or more, the information on the branch points includes the number of secondary branch groups (one in FIG. 11), a secondary branch starting point (first indoor unit of FIG. 11), the number of indoor units inside the secondary branch group (second indoor unit of FIG. 11), etc. The present disclosure may be also applied to an air conditioning system having a tertiary branch or more. The input unit may be configured to input information on capacities of the outdoor unit and the indoor units, and to input information on a thickness of a refrigerant pipe according to the capacities of the outdoor unit and the indoor units.

The air conditioning system according to the third embodiment of the present disclosure may further include an output unit (not shown) configured to display one or more information on a connection status among the indoor units, the outdoor unit and the refrigerant pipe, a length of the refrigerant pipe, a thickness of the refrigerant pipe, and the filling refrigerant amount.

Figure 7:
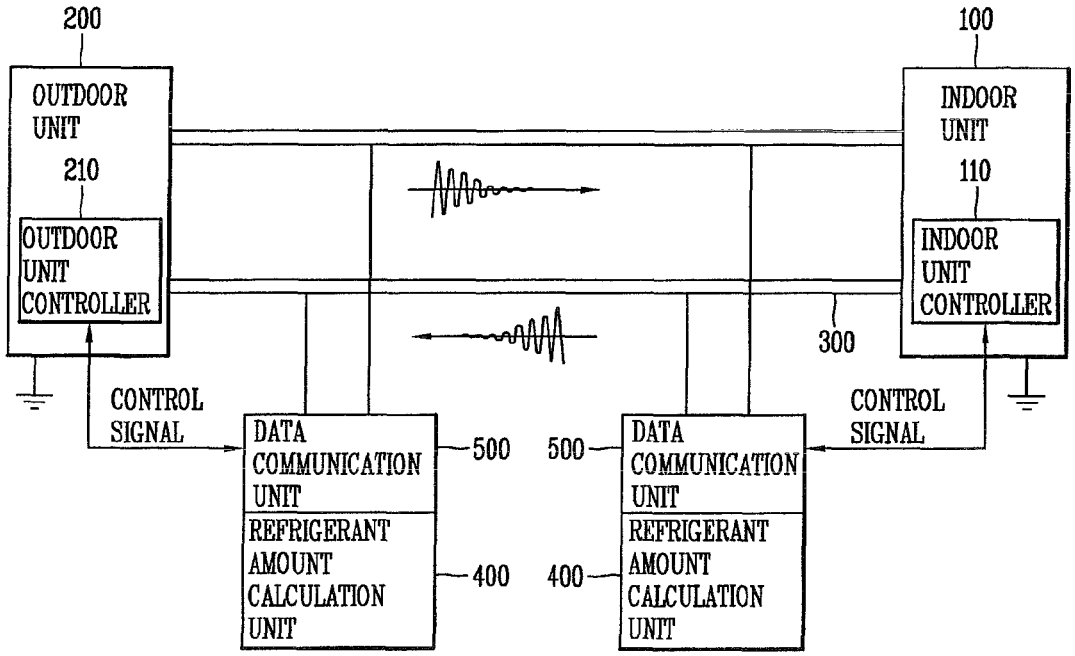
FIG. 7 shows a fourth embodiment of an air conditioning system.

Referring to FIG. 7, an air conditioning system according to a fourth embodiment of the present disclosure includes a plurality of indoor units 100 configured to perform air conditioning processes, one or more outdoor units 200 connected to the indoor units 100 through a refrigerant pipe 300 including one or more branch points 310 and configured to drive the indoor units, a refrigerant amount calculation unit 400 configured to calculate an amount of filling refrigerants based on capacities of the indoor units and the outdoor unit and a length of the refrigerant pipe, and a data communication unit 500 connected between the outdoor unit 200 and the indoor units 100 and configured to transmit and receive data between the outdoor unit 200 and the indoor units 100.

The data communication unit 500 is configured to allow the outdoor unit or the indoor units to transmit or receive driving data thereof through the refrigerant pipes, or additional exclusive lines (e.g., RS-485). The data communication unit 500 may be configured to transmit or receive information on the indoor units and the outdoor unit, information on the refrigerant pipe, information on the branch points, etc. In FIG. 7, the data communication unit 500 and the refrigerant amount calculation unit 400 are separately configured, but may be integrally configured as one unit.

Figure 12:
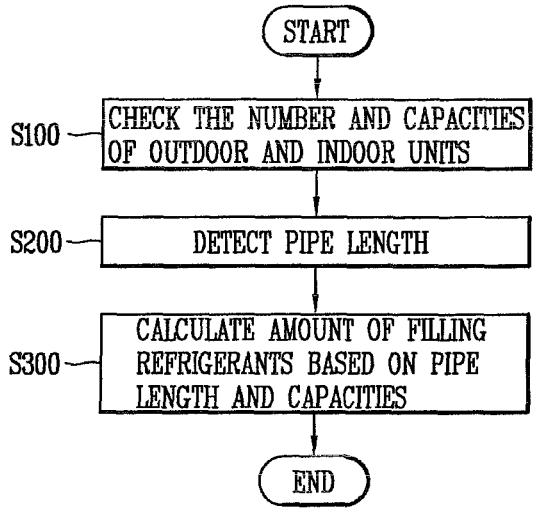
FIGS. 12 and 13 are flowcharts showing steps included in one embodiment of a method for calculating an amount of filling refrigerants of an air conditioning system.
Figure 13:
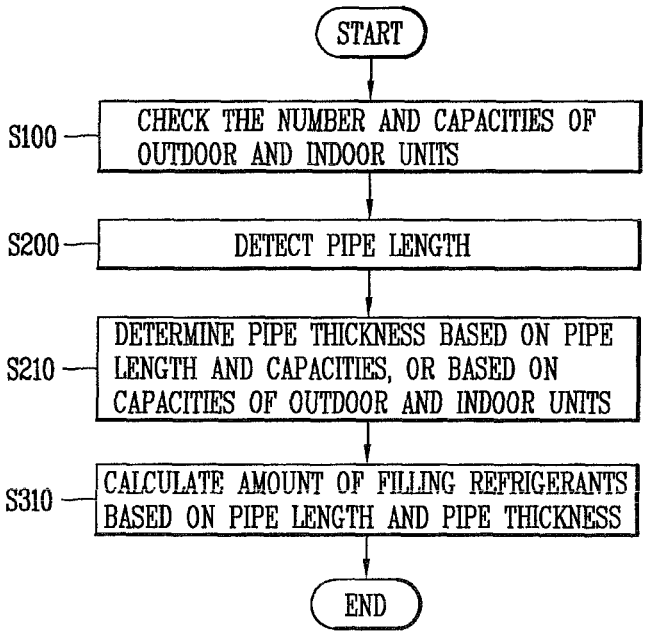

Referring to FIG. 12 or 13, in an air conditioning system having a plurality of indoor units which perform air conditioning processes, and one or more outdoor units connected to the indoor units through refrigerant pipes having one or more branch points and configured to drive the indoor units, a method for calculating an amount of filling refrigerants of the air conditioning system according to the present disclosure includes a refrigerant amount calculating step of calculating an amount of filling refrigerants based on capacities of the outdoor units and the indoor units and a length of the refrigerant pipe (S300). Configurations of the apparatus will be explained with reference to FIGS. 2 to 10.

The air conditioning system calculates an amount of filling refrigerants by adding an indoor unit filling refrigerant amount according to capacities of the indoor units, an outdoor unit filling refrigerant amount according to a capacity of the outdoor unit, and a pipe filling refrigerant amount to one another (S300).

More concretely, the air conditioning system calculates an amount of filling refrigerants by multiplying an outdoor unit filling refrigerant amount according to a capacity of the outdoor unit and an indoor unit filling refrigerant amount according to capacities of the indoor units, with a value obtained by multiplying a pipe filling refrigerant amount per a unitary length with a length of a refrigerant pipe, or by adding an outdoor unit filling refrigerant amount according to a capacity of the outdoor unit and an indoor unit filling refrigerant amount according to capacities of the indoor units to a preset pipe filling refrigerant amount (S300).

Referring to FIG. 12, the method for calculating an amount of filling refrigerants of the air conditioning system further includes a length detecting step (S200) of detecting a length of the refrigerant pipe based on a strength of a signal received by the outdoor unit or the indoor units.

The air conditioning system calculates an amount of filing refrigerants by multiplying a preset outdoor unit filling refrigerant amount according to a capacity of the outdoor unit and a preset indoor unit filling refrigerant amount according to capacities of the indoor units, with a value obtained by multiplying a pipe filling refrigerant amount per a unitary length with a length of a refrigerant pipe, or by adding the outdoor unit filling refrigerant amount according to a capacity of the outdoor unit and the indoor unit filling refrigerant amount according to capacities of the indoor units to a preset pipe filling refrigerant amount (S300). Here, the pipe filling refrigerant amount per a unitary length is variable according to a thickness of the refrigerant pipe, etc.

Figure 14:
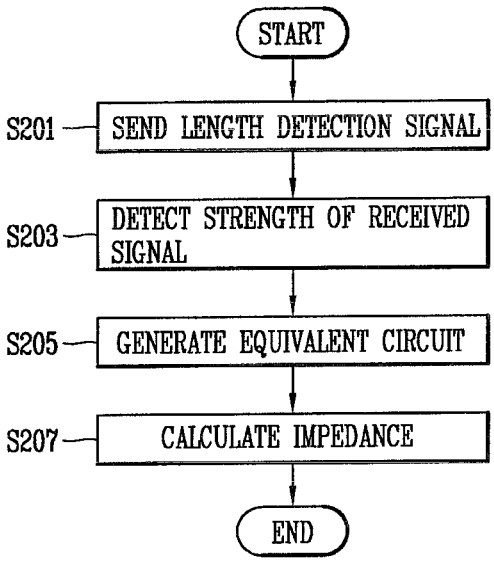
FIGS. 14 and 15 are flowcharts showing steps which may be used in accordance with the method of FIGS. 12 and 13.

Referring to FIG. 14, the length detecting step (S200) includes a first process (S201) of transmitting a length detection signal by the outdoor unit and the indoor units, a second process (S203) of detecting a strength of a signal received by the outdoor unit or the indoor units, and a third process (not shown) of detecting a length of the refrigerant pipe based on strengths of the length detection signal and the received signal.

All of the outdoor unit and the indoor units inside the air conditioning system transmit the length detection signal according to a predetermined order (S201). The process of detecting the received signal (S203) includes a noise removing process of removing noise from the received signal, and a signal converting process of converting the received signal into a digital signal.

The air conditioning system generates an equivalent circuit based on the length detection signal and the received signal (S205), calculates an impedance of the refrigerant pipe by using the equivalent circuit (S207), and thereby detects a length of the refrigerant pipe. The equivalent circuit is differently formed according to an installation environment. For instance, a length detection unit installed at the outdoor unit may be indicated by 'Vin', and length detection units installed at the plurality of indoor units may be indicated by 'V1, V2, . . . Vn'.

In the equivalent circuit, each branch point is indicated by a node and refrigerant pipes connected to the respective branch points are indicated by impedances (resistances), which may be indicated as Z1, Z2, . . . Z2*n*−1, sequentially. An impedance of the refrigerant pipe may be calculated by the equation 1 by applying Kirchhoff's voltage laws (KVL) to the equivalent circuit, and a length of the refrigerant pipe is detected by the equation 2.

Figure 15:
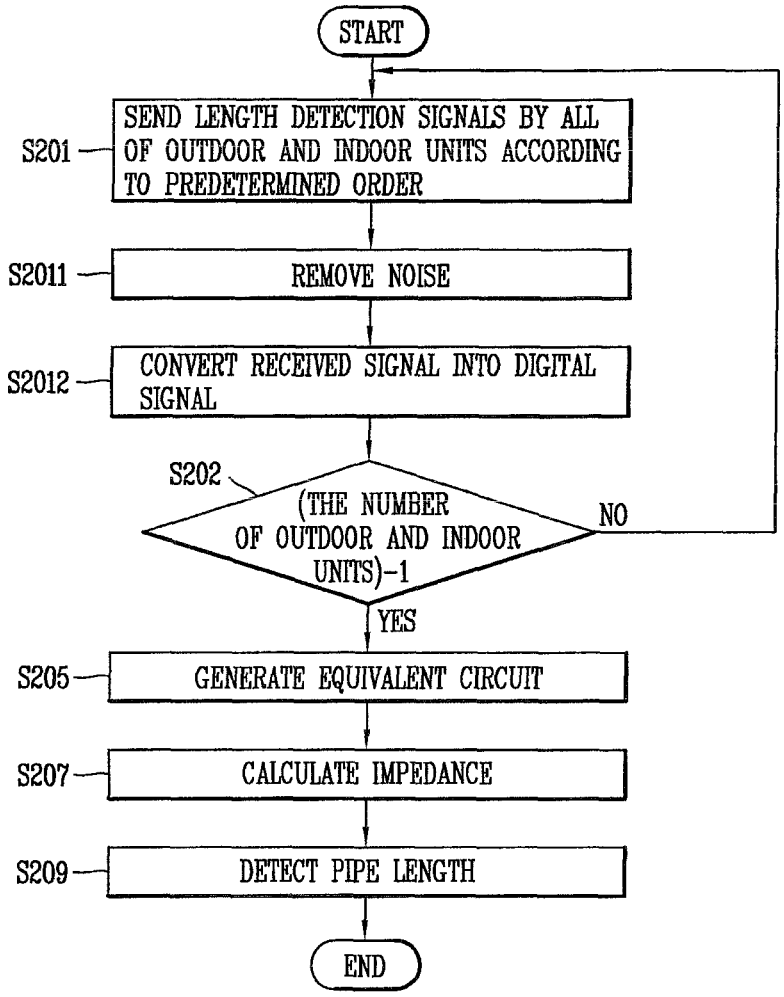

Referring to FIG. 15, all of the outdoor unit and the indoor units inside the air conditioning system transmit the length detection signal according to a predetermined order. For instance, the outdoor unit, the first indoor unit (100A), the second indoor unit (100B) . . . and the nth indoor unit (100N) transmit the length detection signal to other outdoor unit and indoor units, sequentially. Here, outdoor unit and indoor units rather than the transmission side outdoor unit or indoor units receive the length detection signal.

Referring to FIG. 15, in the method for calculating an amount of filling refrigerants of the air conditioning system according to the present disclosure, the process of detecting the received signal (S203) includes a noise removing process (S2011) of removing noise from the received signal, and a signal converting process (S2012) of converting the received signal into a digital signal. The method for calculating an amount of filling refrigerants of the air conditioning system may further include a digital signal storing step (not shown).

The air conditioning system removes an external noise signal of the length detection signal, i.e., a received signal, through a band pass filter (BPF). Once a length detection signal transmitted from the outdoor unit or the indoor units is received to the length detection unit through the refrigerant pipe, the length detection unit removes a noise signal from the received signal (S2011). Then, the length detection unit converts the received signal having a noise signal removed therefrom, into a digital signal (S2012). Then, the length detection unit stores the digital signal, or generates an equivalent circuit.

Referring to FIG. 15, in the method for detecting a length of a refrigerant pipe of an air conditioning system according to the present disclosure, the step of detecting a length of a refrigerant pipe (S200) includes a process of generating an equivalent circuit based on the length detection signal and the received signal (S205). Also, the step of detecting a length of a refrigerant pipe (S200) includes a process of calculating an impedance of each refrigerant pipe based on a strength of a signal received from the equivalent circuit with respect to the length detection signal (S207), and a process of calculating a pipe length based on the calculated impedance (S209).

Referring to FIG. 10, the air conditioning system generates an equivalent circuit, and applies Kirchhoff's voltage laws (KVL) to the equivalent circuit, thereby calculating a length of the refrigerant pipe through the equations 1 and 2. FIG. 10 is a view of an equivalent circuit of FIG. 9, the equivalent circuit having a secondary branch. Branch points of FIG. 9 are indicated by nodes of FIG. 10, refrigerant pipes among the outdoor unit, the indoor units and the branch points are indicated by impedances (resistances), and each length detection unit is indicated by a voltage having a predetermined resistance. The indoor units which constitute the secondary branch of FIG. 9 are indicated by 'V2~V4' in FIG. 10, and the refrigerant pipes which constitute the indoor units form a small circuit of 'X4~X8'.

The air conditioning system according to the present disclosure differently forms an equivalent circuit according to an installation environment. In case of a secondary branch or more, information on the branch points includes the number of secondary branch groups (one in FIG. 11), a secondary branch starting point (first indoor unit in FIG. 11), the number of indoor units inside the secondary branch group (second indoor unit of FIG. 11), etc. The present disclosure may be also applied to an air conditioning system having a tertiary branch or more.

The method for calculating an amount of filling refrigerants of the air conditioning system according to one embodiment of the present disclosure includes a step of checking the number and capacities of the outdoor unit and the indoor units (S100). And, the air conditioning system may further include a step (not shown) of receiving, from outside, at least one of information on the outdoor unit and the indoor units, information on the refrigerant pipe, and information on the branch points.

Referring to FIG. 13, in an air conditioning system having a plurality of indoor units which perform air conditioning processes, and one or more outdoor units connected to the indoor units through refrigerant pipes having one or more branch points and configured to drive the indoor units, a method for calculating an amount of filling refrigerants of the air conditioning system according to another embodiment of the present disclosure includes a length detecting step (S200) of detecting a length of the refrigerant pipe based on a strength of a signal received by the outdoor unit or the indoor units, a thickness determining step (S210) of determining a thickness of the refrigerant pipe based on capacities of the outdoor unit and the indoor units, and a refrigerant amount calculating step (S300) of calculating an amount of filling refrigerants based on capacities of the indoor units and the outdoor unit and a length of the refrigerant pipe.

In the thickness determining step of the method for calculating an amount of filling refrigerants of the air conditioning system, a pipe thickness between the outdoor unit and a branch point nearest to the outdoor unit is determined based on a capacity of the outdoor unit. Alternatively, in the thickness determining step, a thickness of a refrigerant pipe between the branch points, and each thickness of refrigerant pipes between the branch points and the indoor units are determined based on capacities of the indoor units connected to rear ends of the branch points. Here, the pipe thickness may be determined by using the tables 1 and 2.

Figure 16:
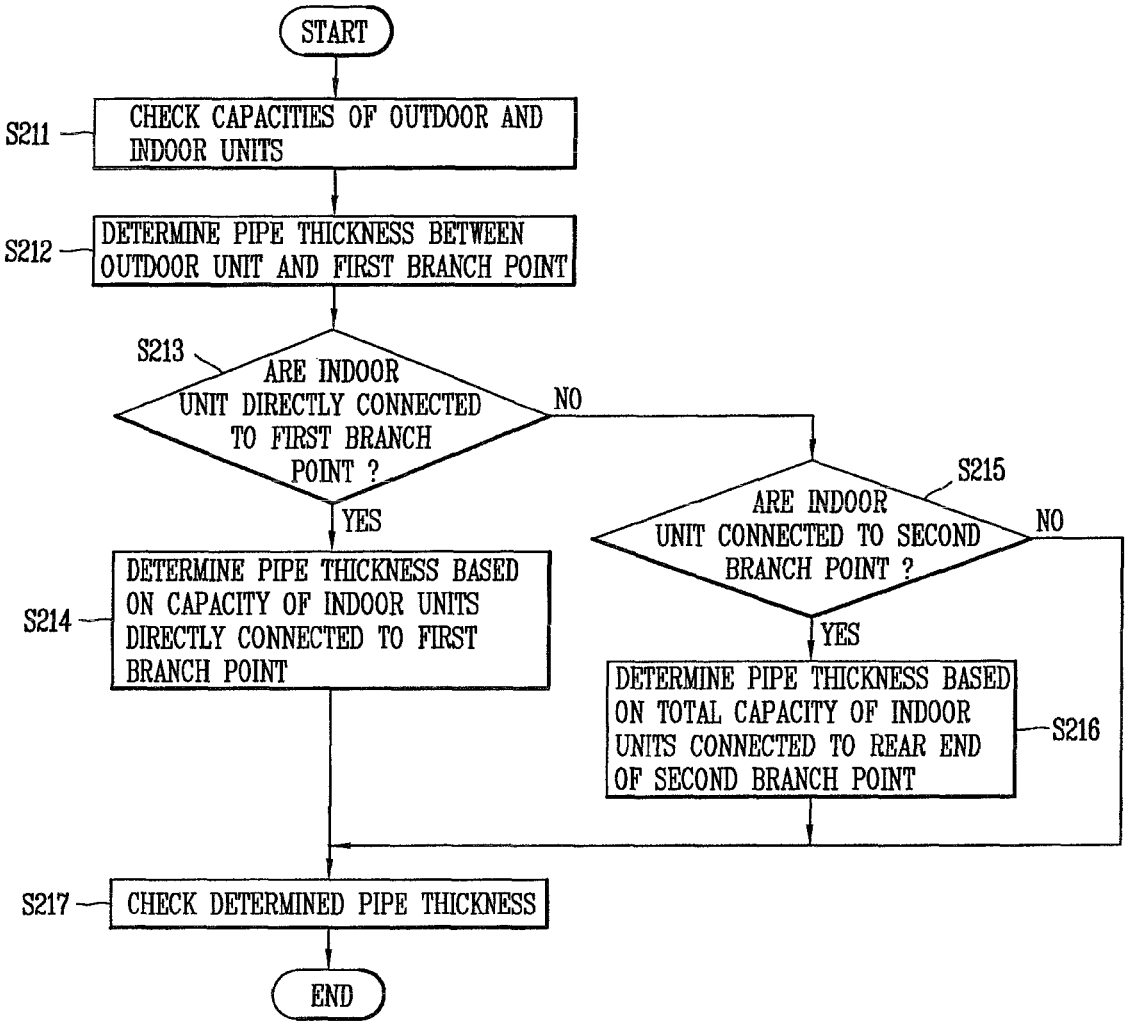
FIG. 16 is a flowchart showing steps included in a process that may be used for determining a pipe thickness in accordance with the method of FIGS. 12 and 13.

Referring to FIG. 16, the thickness determining step (S210) includes a process (S211) of identifying a capacity of the outdoor unit, a process (S212) of determining a thickness of a refrigerant pipe connected between the outdoor unit and a first branch point based on the capacity of the outdoor unit, a process (S213) of checking whether the indoor units have been directly connected to a rear end of the first branch point, and a process (S214) of determining a thickness of the refrigerant pipe based on a capacity of the indoor units if it has been checked in S213 that the indoor units are directly connected to the rear end of the first branch point. Also, the thickness determining step (S210) includes a process (S215) of checking whether a second branch point has been connected to the first branch point if it has been checked in S213 that the indoor units are not directly connected to the rear end of the first branch point, and a process (S216) of determining a thickness of the refrigerant pipe based on a total capacity of the indoor units connected to a rear end of the second branch point if it has been checked in S215 that the second branch point is connected to the first branch point.

In the refrigerant amount calculating step (S300) of the method for calculating an amount of filling refrigerants of the air conditioning system according to another embodiment of the present disclosure, the filling refrigerant amount is calculated based on an indoor unit filling refrigerant amount according to a capacity of the indoor units, an outdoor unit filling refrigerant amount according to a capacity of the outdoor unit, and a pipe filling refrigerant amount according to a length and a thickness of the refrigerant pipe. In the refrigerant amount calculating step (S300), the filling refrigerant amount may be calculated based on the pre-stored pipe filling refrigerant amount.

The method for calculating an amount of filling refrigerants of the air conditioning system according to another embodiment of the present disclosure may further include a step of checking the number and capacities of the outdoor unit and the indoor units (S100). The air conditioning system may further include a step (not shown) of receiving, from outside, at least one of information on the outdoor unit and the indoor units, information on the refrigerant pipe, and information on the branch points.

The method for calculating an amount of filling refrigerants of the air conditioning system according to the present disclosure may further include a step (not shown) of displaying one or more information on a connection status among the indoor units, the outdoor unit and the refrigerant pipes, a length of the refrigerant pipe, thickness of the refrigerant pipe, and the filling refrigerant amount.

As aforementioned, according to the present disclosure, in the air conditioning system having a plurality of indoor units and one or more outdoor units, an amount of filling refrigerants may be automatically calculated before filling refrigerants of the air conditioning system based on a length of the refrigerant pipe having one or more branches, and a thickness of the refrigerant pipe according to capacities of the indoor units and the outdoor unit.

Therefore, an object at least one of the embodiments herein is to provide an air conditioning system capable of precisely calculating an amount of filling refrigerants before filling refrigerants when a plurality of indoor units and one or more outdoor units are connected to one another by refrigerant pipes having one or more branch points, and a method for calculating an amount of filling refrigerants of the same.

Another object is to provide an air conditioning system capable of precisely calculating an amount of filling refrigerants according to installation conditions such as capacities of indoor units and an outdoor unit, a length of a refrigerant pipe, a thickness of a refrigerant pipe, the number and positions of branch points, etc., and a method for calculating an amount of filling refrigerants.

To achieve these and other advantages and in accordance with the purpose of the present disclosure, as embodied and broadly described herein, there is provided an air conditioning system including a plurality of indoor units configured to perform air conditioning processes, one or more outdoor units connected to the indoor units through a refrigerant pipe including one or more branch points and configured to drive the indoor units, and a refrigerant amount calculation unit configured to calculate an amount of filling refrigerants based on capacities of the indoor units and the outdoor unit and a length of the refrigerant pipe.

The air conditioning system may further include a length detection unit connected to each of the outdoor unit and the indoor units, and configured to detect a length of the refrigerant pipe based on a strength of a signal received by the outdoor unit or the indoor units.

The length detection unit of the air conditioning system may include a noise filter module configured to remove noise from the received signal, a conversion module configured to convert the received signal into a digital signal, and a calculation module configured to calculate a length of the refrigerant pipe based on the digital signal. The length detection unit may generates an equivalent circuit based on the length detection signal and the received signal, and detects a length of the refrigerant pipe by using the equivalent circuit. The length detection unit may further include a storage module configured to store a length of the refrigerant pipe.

The air conditioning system may further include a thickness determination unit configured to determine a thickness of the refrigerant pipe based on capacities of the outdoor unit and the indoor units.

The refrigerant amount calculation unit may be configured to calculate an amount of filling refrigerants based on an indoor unit filling refrigerant amount according to capacities of the indoor units, an outdoor unit filling refrigerant amount according to a capacity of the outdoor unit, and a pipe filling refrigerant amount according to a length and a thickness of the refrigerant pipe. Here, the refrigerant amount calculation unit may calculate the filling refrigerant amount based on a pre-stored pipe filling refrigerant amount.

The thickness determination unit may determine a pipe thickness between the outdoor unit and a branch point nearest to the outdoor unit, based on a capacity of the outdoor unit. The thickness determination unit may determine a thickness of a refrigerant pipe between branch points, and each thickness of refrigerant pipes between the branch points and the indoor units based on capacities of the indoor units connected to rear ends of the branch points.

The air conditioning system according to present disclosure may further include a data communication unit connected between the outdoor unit and the indoor units, and configured to transmit and receive data between the outdoor unit and the indoor units.

The air conditioning system according to the present disclosure may further include an input unit configured to receive information on the branch points. The air conditioning system according to the present disclosure may further include a storage unit configured to store a pipe filling refrigerant amount according to a length and a thickness of the refrigerant pipe. The air conditioning system according to the present disclosure may further include an output unit configured to display one or more information on a connection status among the indoor units, the outdoor unit and the refrigerant pipes, a length of the refrigerant pipe, a thickness of the refrigerant pipe, and the filling refrigerant amount.

To achieve these and other advantages and in accordance with the purpose of the present disclosure, as embodied and broadly described herein, there is also provided a method for calculating an amount of filling refrigerants of an air conditioning system having a plurality of indoor units which perform air conditioning processes, and one or more outdoor units connected to the indoor units through refrigerant pipes having one or more branch points and configured to drive the indoor units, the method including a refrigerant amount calculating step of calculating an amount of filling refrigerants based on capacities of the outdoor units and the indoor units and a length of the refrigerant pipe.

The method for calculating an amount of filling refrigerants of an air conditioning system according to the present disclosure may further include a length detecting step of detecting a length of the refrigerant pipe based on a strength of a signal received by the outdoor unit or the indoor units.

The length detecting step may include a first process of transmitting a length detection signal by the outdoor unit and the indoor units, a second process of detecting a strength of a signal received by the outdoor unit or the indoor units, and a third process of detecting a length of the refrigerant pipe based on strengths of the length detection signal and the received signal.

The method for calculating an amount of filling refrigerants of an air conditioning system according to the present disclosure may further include a thickness determining step of determining a thickness of the refrigerant pipe based on capacities of the outdoor unit and the indoor units.

In the thickness determining step of the method for calculating an amount of filling refrigerants of the air conditioning system, a pipe thickness between the outdoor unit and a branch point nearest to the outdoor unit may be determined based on a capacity of the outdoor unit. Alternatively, in the thickness determining step, a thickness of a refrigerant pipe between the branch points, and each thickness of refrigerant pipes between the branch points and the indoor units may be determined based on capacities of the indoor units connected to rear ends of the branch points.

In the refrigerant amount calculating step of the method for calculating an amount of filling refrigerants of the air conditioning system according to the present disclosure, the filling refrigerant amount may be calculated based on an indoor unit filling refrigerant amount according to capacities of the indoor units, an outdoor unit filling refrigerant amount according to a capacity of the outdoor unit, and a pipe filling refrigerant amount according to a length and a thickness of the refrigerant pipe. In the refrigerant amount calculating step, the filling refrigerant amount may be calculated based on a pre-stored pipe filling refrigerant amount.

The method for calculating an amount of filling refrigerants of the air conditioning system according to the present disclosure may further include a step of displaying one or more information on a connection status among the indoor units, the outdoor unit and the refrigerant pipe, a length of the refrigerant pipe, a thickness of the refrigerant pipe, and the filling refrigerant amount.

In the air conditioning system having a plurality of indoor units and one or more outdoor units, and the method for calculating an amount of filling refrigerants, an amount of filling refrigerants may be automatically calculated before filling refrigerants in the air conditioning system. This may reduce an installation time.

In the present disclosure, an amount of filling refrigerants may be automatically calculated according to installation conditions such as capacities of indoor units and an outdoor unit, a length of a refrigerant pipe, a thickness of a refrigerant pipe, the number and positions of branch points, etc. This may allow an amount of filling refrigerants to be precisely calculated, reduce a refrigerant amount calculation error, and prevent wastes of a refrigerant amount.

In the present disclosure, an amount of filling refrigerants may be automatically calculated before filling refrigerants in the air conditioning system based on a length of a refrigerant pipe having one or more branch points, and a thickness of the refrigerant pipe according to capacities of the indoor units and the outdoor unit. This may enhance a user's convenience and reliability of the system.

In accordance with another embodiment, an air conditioning system comprises a plurality of indoor units; one or more outdoor units to drive the indoor units, the one or more outdoor units coupled to the indoor units through refrigerant pipes that include one or more branch points; and a calculator to calculate an amount of filling refrigerant based on capacities of the indoor units and the one or more outdoor units and lengths of the refrigerant pipes.

The system may also include a length detector to detect a length of one or more of the refrigerant pipes based on a strength of a signal received by at least one of the outdoor unit or the indoor units. The length detector may comprise a noise filter to remove noise from the received signal; a converter to convert the received signal into a digital signal; and a calculation module to calculate a length of one or more of the refrigerant pipes based on the digital signal. In addition, the length detector may operate based on an equivalent circuit, the equivalent circuit to detect a length of one or more of the refrigerant pipes based on the received signal.

The system may also include a thickness determiner to determine a thickness of the one or more refrigerant pipes based on the capacities of the one or more outdoor units and the indoor units. The thickness determiner may determine a thickness of the one or more refrigerant pipes between the outdoor unit and a branch point nearest to the one of the outdoor units based on a capacity of said one of the outdoor units.

Also, the thickness determiner may determines a thickness of the one or more refrigerant pipes between at least two branch points, and a thickness of each of the one or more refrigerant pipes between the branch points and the indoor units based on capacities of the indoor units coupled to rear ends of the branch points.

In addition, the system may include a data communicator, coupled between the one or more outdoor units and the indoor units, to transmit and receive data between the one or more outdoor units and the indoor units.

In addition, the calculator may calculate the amount of filling refrigerants based on capacities of the indoor units, the one or more outdoor units, and the length and a thickness of each of the one or more refrigerant pipes.

The system may also include a storage unit to store a pipe filling refrigerant amount according to the length and thickness of one or more of the refrigerant pipes.

In accordance with another embodiment, a method for controlling an air conditioning system comprises determining a capacity of at least one outdoor unit; determining capacities of indoor units driven by the outdoor unit; determining lengths of pipes between the at least one outdoor unit and the indoor units; and calculating an amount of filling refrigerant based on the capacities of the at least one outdoor unit, the capacities of the indoor units, the lengths of the pipe between the at least one outdoor unit and the indoor units.

The method may further include detecting a length of one or more of the pipes based on a strength of a received signal transmitted between the one or more outdoor units and at least one of the indoor units.

The method may further include transmitting a signal between the one or more outdoor units and at least one of the indoor units; detecting a strength of the signal as received by the one or more outdoor units or said at least one of the indoor units; and detecting a length of one or more of the pipes based on a strength of the received signal.

The transmitting step may include transmitting respective signals between the one or more outdoor units and the indoor units in a predetermined order; detecting respective strengths of the signals as received by the one or more outdoor units or the indoor units; and detecting lengths of respective ones of the pipes based on the detects strengths of corresponds ones of the received signals.

The strength detecting may include removing noise from the received signal; and converting the received signal into a digital signal.

The length detecting includes operating a length detector based on an equivalent circuit that determines lengths of one or more of the pipes based on the digital signal.

The method may also include determining a thickness of one or more of the pipes based on capacities of the one or more outdoor units and the indoor units. The one or more pipes may be located between an outdoor unit and a branch point nearest to the outdoor unit and wherein the thickness of the one or more pipes is determined based on a capacity of the outdoor unit.

The step of determining thickness includes determining a thickness of one or more pipes between an outdoor unit and one or more corresponding branch points, determining thicknesses of ones of the pipes between respective branch points and the indoor units based on capacities of the indoor units connected to rear ends of the branch points.

Further, the amount of filling refrigerants may be determined based on capacities of the indoor units, the one or more outdoor units, and the length and a thickness of each of the one or more refrigerant pipes.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of any one embodiment may be combined with one or more features of the remaining embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning system, comprising:

a plurality of indoor devices;

one or more outdoor devices to drive the plurality of indoor devices, the one or more outdoor devices being coupled to the plurality of indoor devices through at least one refrigerant pipe that includes one or more branch points;

a length detector to detect a length of the at least one refrigerant pipe based on a signal received by at least one of the one or more outdoor devices or the plurality of indoor devices; and a calculator to calculate an amount of filling refrigerant based on capacities of the plurality of indoor devices and the one or more outdoor devices and the length of the at least one refrigerant pipe, wherein the length of the at least one pipe is detected using the following equation:

$$\text{pipelength}=Z\text{pipe}/\alpha$$

where $\alpha$ is impedance per unitary length and Zpipe is calculated using the following equation:

$$Z\text{pipe}=I^{-1}V$$

where $I^{-1}$ is a current and V is a voltage of the signal.

2. The air conditioning system of claim 1, wherein the length detector comprises:

a noise filter to remove noise from the received signal;

a converter to convert the received signal into a digital signal; and a calculation module to calculate the length of the at least one refrigerant pipe based on the digital signal.

3. The air conditioning system of claim 1, wherein the length detector operates based on an equivalent circuit, the equivalent circuit being used to detect the length of the at least one refrigerant pipe based on the received signal.

4. The air conditioning system of claim 1, further comprising:

a thickness determiner to determine a thickness of the at least one refrigerant pipe based on the capacities of the one or more outdoor devices and the plurality of indoor devices.

5. The air conditioning system of claim 4, wherein the thickness determiner determines a thickness of the at least one pipe between one of the one or more outdoor devices and a branch point nearest to the one of the one or more outdoor devices based on a capacity of the one of the one or more outdoor devices.

6. The air conditioning system of claim 4, wherein the thickness determiner determines:

a thickness of the at least one refrigerant pipe between at least two branch points; and a thickness of the at least one pipe between the at least two branch points and the plurality of indoor devices based on capacities of the plurality of indoor devices coupled to rear ends of the at least two branch points.

7. The air conditioning system of claim 4, wherein the calculator calculates the amount of filling refrigerants based on capacities of the plurality of indoor devices, the one or more outdoor devices, and the length and a thickness of each of the at least one refrigerant pipe.

8. The air conditioning system of claim 7, further comprising:

a storage device to store a pipe filling refrigerant amount according to the length and thickness of at least one refrigerant pipe.

9. The air conditioning system of claim 1, further comprising:

a data communicator, coupled between the one or more outdoor devices and the plurality of indoor devices, to transmit and receive data between the one or more outdoor devices and the plurality of indoor devices.

10. A method for controlling an air conditioning system, comprising:

determining by the air conditioning system a capacity of at least one outdoor device;

determining by the air conditioning system capacities of a plurality of indoor devices driven by the at least one outdoor device;

determining by the air conditioning system a length of at least one pipe between the at least one outdoor device and the plurality of indoor devices based on a strength of a signal transmitted between the at least one outdoor device and one of the plurality of indoor devices; and calculating by the air conditioning system an amount of filling refrigerant based on the capacity of the at least one outdoor device, the capacities of the plurality of indoor devices, and the length of the at least one pipe between the at least one outdoor device and the plurality of indoor devices, wherein the length of the at least one pipe is determined using the following equation:

$$\text{pipelength}=Z\text{pipe}/\alpha$$

where $\alpha$ is impedance per unitary length and Zpipe is calculated using the following equation:

$$Z\text{pipe}=I^{-1}V$$

where $I^{-1}$ a current and V is a voltage of the signal.

11. The method of claim 10, further comprising:

transmitting respective signals between the at least one outdoor device and the plurality of indoor devices in a predetermined order;

detecting respective strengths of the signals as received by the at least one outdoor device or the plurality of indoor devices; and detecting lengths of respective ones of the at least one pipe based on the detected strengths of corresponding ones of the received signals.

12. The method of claim 10, wherein the strength detecting includes:

removing noise from the signal; and converting the signal into a digital signal.

13. The method of claim 12, wherein the length detecting includes:

operating a length detector based on an equivalent circuit that determines lengths of the at least one pipe based on the digital signal.

14. The method of claim 10, further comprising:

determining a thickness of the at least one pipe based on capacities of the at least one outdoor device and the plurality of indoor devices.

15. The method of claim 14, wherein the at least one pipe is between one of the at least one outdoor device and a branch point nearest to the one of the at least one outdoor device, and wherein the thickness of the at least one pipe is determined based on a capacity of the one of the at least one outdoor device.

16. The method of claim 14, wherein the determining the thickness includes:

determining a thickness of one pipe of the at least one pipe between one of the at least one outdoor device and one or more corresponding branch points; and determining thicknesses of pipes of the at least one pipe between respective branch points and the plurality of indoor devices based on capacities of the plurality of indoor devices connected to rear ends of the branch points.

17. The method of claim 14, wherein the amount of filling refrigerants is determined based on capacities of the plurality of indoor devices, the at least one outdoor device, and the length and a thickness of each of the at least one refrigerant pipe.

* * * * *